US005603293A

United States Patent [19]

Schwarzenthal et al.

[11] Patent Number: 5,603,293

[45] Date of Patent: Feb. 18, 1997

[54] TAPPET FOR A SWITCHABLE VALVE OF AN INTERNAL COMBUSTION ENGINE

[75] Inventors: Dietmar Schwarzenthal, Bergisch Gladbach; Joachim Grünberger, Sachsenheim, both of Germany

[73] Assignee: Dr. Ing. h.c.F. Porsche AG, Weissach, Germany

[21] Appl. No.: 568,291

[22] Filed: Dec. 6, 1995

[30] Foreign Application Priority Data

Dec. 15, 1994 [DE] Germany ..... 44 44 699.3

[51] Int. Cl.[6] ..... F01L 1/12

[52] U.S. Cl. ..... 123/90.16; 123/90.48; 123/198 F

[58] Field of Search ..... 123/90.15, 90.16, 123/90.48, 198 F

[56] References Cited

U.S. PATENT DOCUMENTS

| | | | |
|---|---|---|---|
| 4,770,137 | 9/1988 | Okabe et al. | 123/198 F |
| 5,361,734 | 11/1994 | Shirai | 123/90.16 |
| 5,402,756 | 4/1995 | Bohme et al. | 123/90.16 |
| 5,488,934 | 2/1996 | Shirai et al. | 123/90.16 |

FOREIGN PATENT DOCUMENTS

| | | |
|---|---|---|
| 668436A1 | 8/1995 | European Pat. Off. . |
| 2952037A1 | 6/1981 | Germany . |
| 4219435A1 | 12/1993 | Germany . |
| 4405189A1 | 8/1995 | Germany . |
| WO93/18284 | 9/1993 | WIPO . |

*Primary Examiner*—Weilun Lo

*Attorney, Agent, or Firm*—Evenson McKeown Edwards & Lenahan, PLLC

[57] ABSTRACT

A tappet for a switchable valve includes a switching device having a clutch member which can be displaced by a hydraulically acted-upon piston and by means of which the valve is switched off in a second switching position and is activated in a first switching position. In order to permit low-friction defined switching movements of the clutch member and the tappet, the clutch member is in each case locked by means of a respective locking device in its end positions assigned to one switching position respectively. The locking device is operative in the respective end position of the clutch member and can be unlocked by the valve stem.

26 Claims, 3 Drawing Sheets

TAPPET FOR A SWITCHABLE VALVE OF AN INTERNAL COMBUSTION ENGINE

BACKGROUND AND SUMMARY OF THE INVENTION

This invention relates to a tappet for a switchable valve of an internal combustion engine of the type having a hydraulically actuated piston and clutch member for selectively switching valve operation between a valve operating and non-operating position In the case of known tappets of the above-mentioned construction (PCT Publication WO-93/18 284), it is possible that, during the valve stroke and when pressure is admitted to the piston, no clear position is fixed between the valve stem and the bore in the clutch member, which may have the result that the valve stem dips into this bore with a high wear-prone friction. In addition, although, in the case of a correspondingly unfavorable alignment of the valve stem relative to the bore of the clutch member, the clutch member may take along the valve, this takes place only along a partial area of the stroke height from where, under the effect of the valve spring, the valve strikes back into the valve seat in an undamped manner, which causes very disturbing noises and additional wear.

It is an object of the invention to provide a tappet of the above-mentioned type whose clutch member can be switched reliably and in a defined manner out of its end positions in fixed time periods or in the case of defined cam angles so that a low-wear, reliable and fast switching is permitted.

According to the invention, this object is achieved by providing a tappet for an internal combustion engine valve comprising a tappet member which in use is moved by a cam of an engine camshaft, a clutch member movable between a first switching position transmitting tappet member movements to an engine valve and a second switching position without transmitting tappet member movements to the engine valve, whereby an associated engine valve can be switched between operating and non operating conditions, a selectively movable piston engageable to move said clutch member between said first and second switching positions, and first and second locking devices operable to lock the clutch member in respective end positions assigned to the first and second switching positions,said first and second locking devices being operably acted on during use by a valve stem of the engine valve to effect unlocking of the locking devices.

A high switching reliability of such a tappet is achieved by means of the unlockable locking of the clutch member in two end positions assigned to the switching positions of the valve. By means of the locking of the clutch member in these two end positions, it is achieved that the respective switching operation will be possible only after the unlocking of the respective locking device applied to the clutch member. Because of the fact that the locking devices can each be unlocked by the valve stem, the unlocking of the clutch member is possible as a function of the position of the valve stem and therefore of the angle of rotation of the cam or at a defined point in time. Thus, it can be ensured that the switching operation starts in both directions in each case at a fixed point in time or during a fixed time period. This corresponds to a defined angular position of the cam. Thus, the switching operation is carried out in a reliable and defined manner within a short time. An increased wear as a result of excessive frictional forces or edge pressures is therefore excluded. As a result of the fact that the unlocking of the locking devices of the clutch member takes place by means of the valve stem of the valve, it is possible to use standard camshafts. The valve gear may therefore have a correspondingly simple construction since, in particular, a high-expenditure operating hydraulic system in the rotating system of the camshaft will not be necessary.

The locking of the clutch member in the two end positions becomes particularly reliable if it takes place by the effect of a spring element when the end positions are reached. This permits a quasi-automatic locking in the case of end positions without requiring, beyond the intervention of the valve stem, additional switching or locking mechanisms acting from the outside. The spring elements can be integrated in the tappet in a space-saving manner.

An unlocking of one of the locking devices in the upper area of the stroke curve of the corresponding cam can be achieved in an advantageous manner if the clutch member has a bore into which the valve stem can dip in the case of a corresponding position of the clutch member. If the corresponding locking device is positioned such that it is unlocked by the valve stem in the dipped-in position, an unlocking is achieved which correspondingly is in effect in the upper stroke area. The switching point in time can be determined by way of the dipping length of the valve stem.

An unlocking of the second locking device before passing though the base circle range of the cam is achieved when, in the second end position of the clutch member, the valve stem rests against this clutch member.

The switching operation is advantageously achieved by the displacement of the clutch member if it has spaced supporting surfaces on which the piston is supported on the one hand, and the spring element is supported on the other hand, by means of whose interaction the clutch member can be displaced into its respective end positions (when the locking device is unlocked). In preferred embodiments, the tappet is constructed in the manner of a cup such that the piston, the locking devices, the clutch member and a spring element may advantageously be inserted in the interior so that the tappet requires the same amount of space as conventional cup tappets.

An advantageous form of the locking device according to certain preferred embodiments includes a springy lock bolt constructed in the tappet and applied to the clutch member in the corresponding end position. Another advantageous form of the construction of the locking device is obtained by the interaction of two meshing parts of the clutch member and the guideway guiding this clutch member. In this case, the unlocking advantageously takes place by the lifting of the clutch member relative to the guideway.

Other objects, advantages and novel features of the present invention will become apparent from the following detailed description of the invention when considered in conjunction with the accompanying drawings.

DETAILED DESCRIPTION OF THE DRAWINGS

Figure 1:
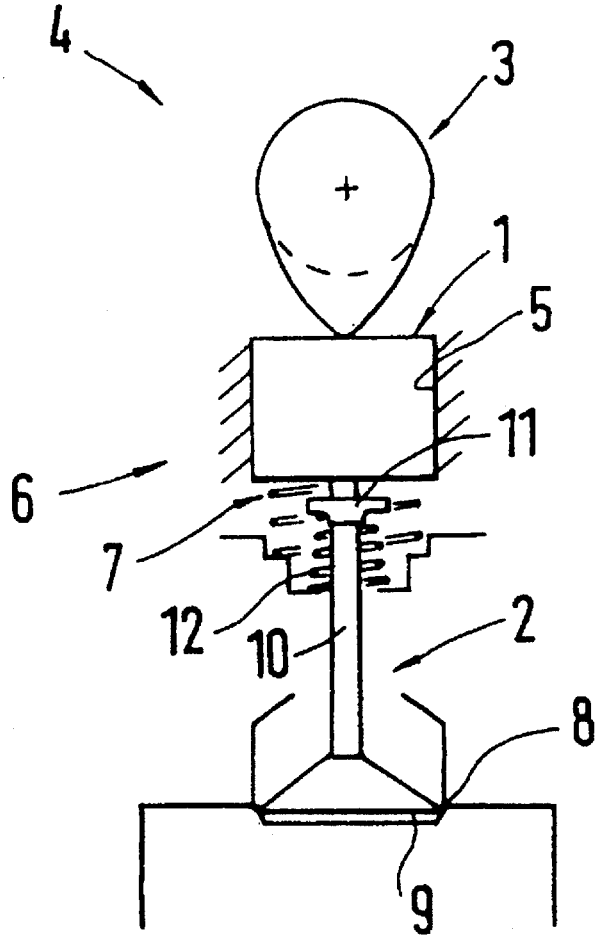
FIG. 1 is a schematic representation of an internal-combustion engine in the area of a cam drive, constructed according to preferred embodiments of the invention.
Figure 2:
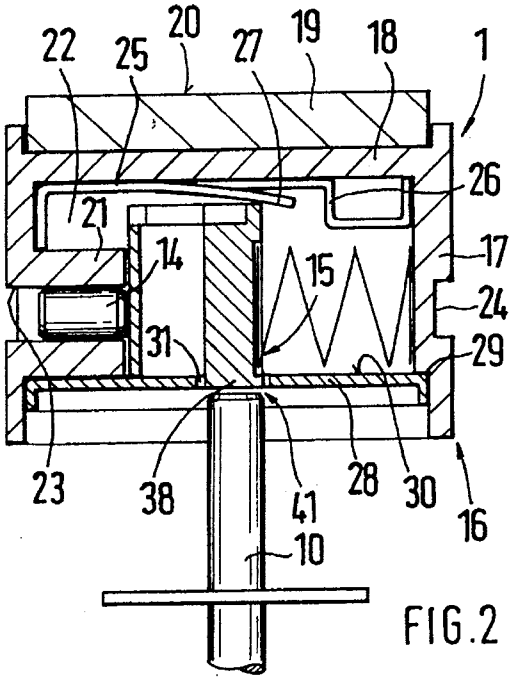
Figure 5:
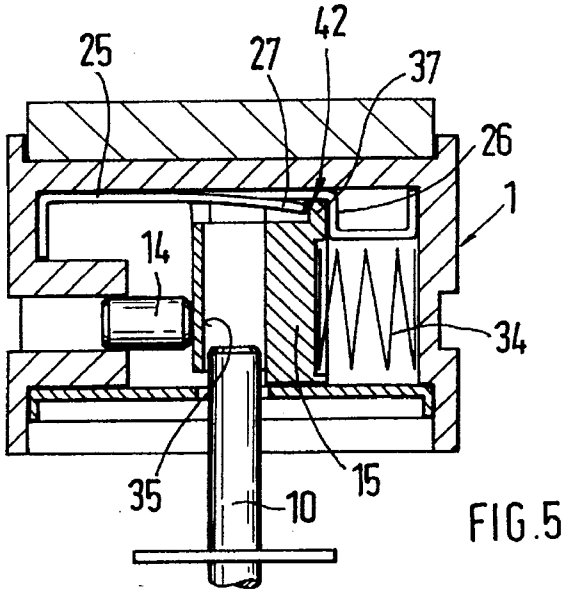

In the area illustrated in FIG. 1, an internal-combustion engine, which is not shown in detail, has a cylindrical tappet 1 which is assigned to a switchable valve 2 and is operated by means of a camshaft 4 having a cam 3. The tappet 1 is inserted into a bore 5 of a cylinder head 6 and is supported by means of a pressure spring 7. The valve 2 comprises a valve disk 9, which interacts with the valve seat 8 of the cylinder head 6, as well as a valve stem 10 which is equipped with a valve spring disk 11. Between the valve spring disk 11 and the cylinder head 6, a valve spring 12 is operative which holds the valve 2 in the closed position or moves it into this position. Within the tappet 1, a device 13 is arranged by means of which two switching positions for the valve 2 can be adjusted. In the first switching position (FIG. 2), the valve 2 is activated; that is, the valve stem follows the movement of the stroke of the tappet applied by the cam. In the other switching position (FIG. 5), the valve 2 is switched off; that is, the tappet 1 follows the stroke movement of the cam 3 while the valve stem maintains its position.

The device 13 for switching the valve 2 is formed by a piston 14 and a clutch member 15 which are integrated into the tappet 1. The tappet 1 has the shape of a cylindrical cup 16; that is, it has a shell part 17 and a cup bottom 18 which extends at a narrow distance from the cam 3. The cup bottom 18 is used for receiving an adjusting plate 19 whose top side 20 is acted upon by the cam 3. From the shell part 17 of the cup 16, an extension 21 projects into the interior 22 which has a bore 23 for receiving and guiding the piston 14. The bore 23 starts out from an annular groove 24 extending around the outer circumference of the shell part 17, by way of which annular groove 24 the piston 14 guided in the bore 23 is acted upon by the pressure medium in a manner known per se.

In the interior 22 of the cup 16, a shaped part 25 is inserted which rests against the cup bottom 18 and, on the side opposite the extension 21, has a section 26 drawn in the downward direction. In the center area of the shaped part 25, a flexible tongue 27 is punched out and is bent downward. On its bottom side, the interior 22 is closed off by a guide plate 28 which rests against a shoulder 29 of the shell part 17 extending around in the interior. The top side of the guide plate 28 is used as a guideway 30 of the clutch member 15 which is displaceable approximately perpendicularly to the valve movement. By means of guides on the shaped part 25 which are not shown in detail, a straight movement of the clutch part 15 is permitted. The guide plate 28 has an opening 31 which is situated opposite the valve stem 10 and which can be penetrated by the valve stem 10 in the case of a corresponding movement.

The clutch member 15 has two mutually opposite supporting surfaces 32, 33. The piston 14 rests against the supporting surface 32 facing the extension 21, while a pressure spring 34 is supported on the opposite supporting surface 33, the other end of the pressure spring 34 resting against the shell part 17. By the admission of pressure to the piston 14 by way of the bore 23 or the annular groove 24, the clutch member 15 can be displaced against the effect of the pressure spring 34. In the direction of the valve movement, the clutch member 15 is penetrated by a through bore 35 whose diameter D is larger than the diameter d of the valve stem. On its top side, the clutch member 15 has an indentation 36 which is open in the upward direction and toward the extension 21 and which is bounded by a stop 37 on the side facing away from the extension 21. In the position of the clutch member 15 illustrated in FIG. 2, the flexible tongue 27 of the shaped part 25 rests on this stop 37. In the second end position of the clutch member 15 illustrated in FIG. 5, the flexible tongue 27 projects past the stop 37 into the indentation 36. 0n its bottom side facing the guide plate 28, the clutch member 15 has an extension 38 which, in the end position illustrated in FIG. 2, projects into the opening 31 of the guide plate. In this shown embodiment, the extension 38 is constructed on the side of the bore 35 facing away from the piston 14.

If, in the case of an unpressurized piston 14, the clutch member 15, under the effect of the pressure spring 34, is in its (left) end position (resting against the extension 21), the extension 38 will project into the opening 31 of the guide plate 28. The valve stem 10 rests against the extension 38 of the clutch member 15. If, during the rotation of the cam 3, the area acting between the cam and the adjusting plate 19, arrives in the transition between the base circle 39 and the flank area 40, the tappet 1 is pressed downward as a result of the stroke effect of the cam 3, until the clutch member 15 is lifted upward against the effect of the flexible tongue 27 and rests against the shaped part 25. After this lifting of the clutch member 15, a rigid connection is obtained between the cam 3, the tappet 1 with the clutch part 15 and the valve stem 10 so that corresponding stroke movements of the valve are triggered. In this embodiment, the cam 3 is constructed such that the base circle 39 comprises an angle of approximately 180° and the flange area 40 comprises also approximately 180° Other cam shapes and other angular ranges are also contemplated. When, after passing through the flank area 40, the effective range between the cam 3 and the adjusting plate 19 returns into the area of the base circle 39, the valve 2 will again be in the closed condition and the clutch member 15 is pressed downward by the effect of the flexible tongue 37 until the extension 38 penetrates into the opening 31.

Figure 4:
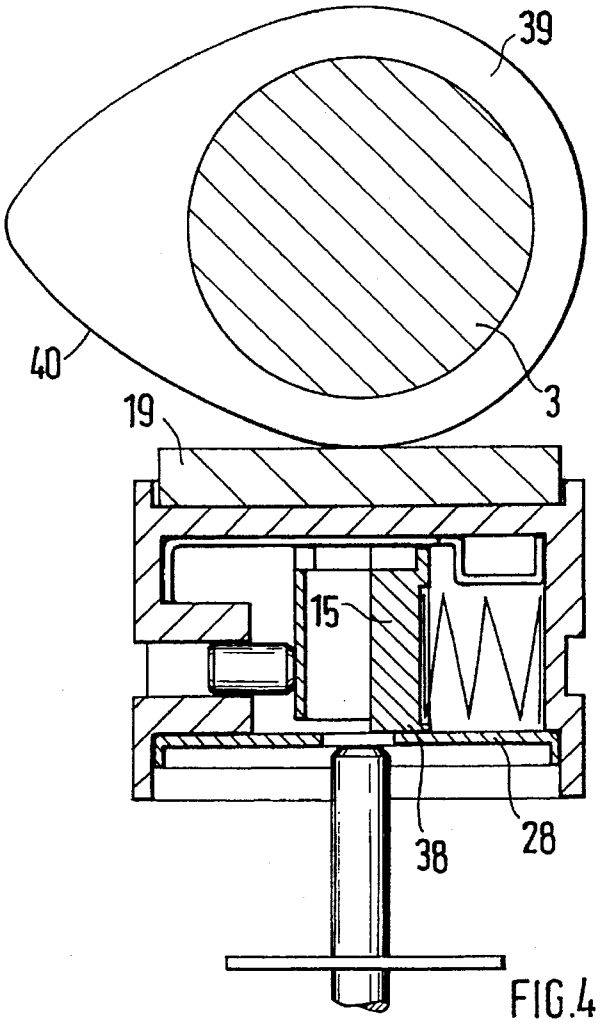
FIGS. 2 to 6 are respective sectional views of a tappet constructed according to a preferred embodiment of the invention with partially outlined cams shown in respective different operating positions.
Figure 3:
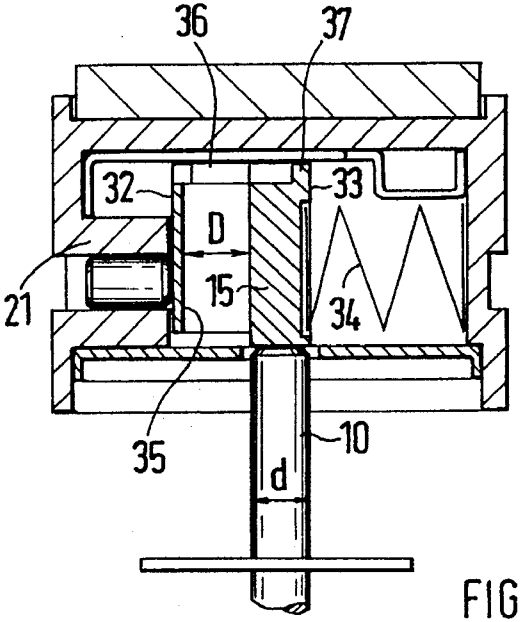

If, on the other hand, the valve 2 is to be switched off, the piston 14 is acted upon by pressure by way of the annular groove 24 and the bore 23. By the effect of the hydraulic pressure, the clutch member 15 is displaced to the right against the effect of the pressure spring 34 until the extension 38 rests against the wall of the opening 31. A displacement beyond that is not possible. The extension 38 and the opening 31 together act as a locking device 41. When, by the interaction of the cam 3 and the adjusting plate 19, the transition from the base circle area 39 into the flank area 40 is reached, the clutch member 15 is lifted—as described above (FIG. 3)—so that the extension 38 dips completely out of the opening 31. Because of the frictional forces between the valve stem 10 and the clutch member 15 acting during the valve stroke (passing through the flank area 40), on the one hand, and between the clutch member 15 and the shaped part 25 or the cup bottom 18, the clutch member 15 is held in this position despite the effective hydraulic pressure on the piston 14. When the area effective between the cam 3 and the adjusting plate 19, after a rotation by approximately 180°, arrives in the transition between the flank area 40 and the base circle 39, when the frictional forces decrease (closed valve), the clutch member 15 can be displaced by the piston 14 against the effect of the pressure spring 34 so that the extension 38 is displaced by way of the opening 31 onto the guiding plate 28 (FIG. 4). The clutch member 15 is then pressed by means of the piston 14 into the (right) end position illustrated in FIG. 5 and rests against the section 26 of the shaped part 25 serving as the end stop. In this end position, the flexible tongue 27 of the shaped part 25 can dip past the stop 37 into the indentation 36. The flexible tongue 27 interacts with the stop 37 as a second locking device 42 and prevents a setting-back of the clutch member 15. In this right end position of the clutch member 15, the valve stem 10 can dip into the bore 35 of the clutch member 15 so that, although the tappet 1 follows the stroke movement of the cam 3, the valve stem 10 and thus the valve 2 are not moved. The valve 2 is therefore switched off. The valve 2 remains in the switched-off position as long as the piston 14 is acted upon by pressure.

Instead of the flexible tongue 27, another angularly movable locking element (such as a pawl) can easily be used which is acted upon by a spring force or by the force of gravity according to other contemplated embodiments.

Figure 6:
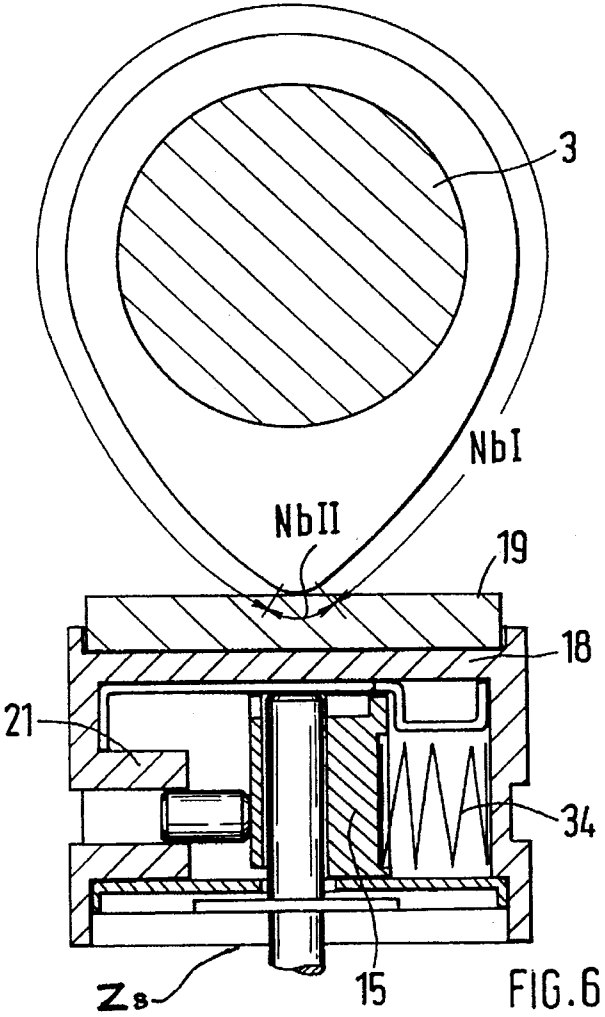

If the valve 2 is to be activated again from this switching position, the piston must be switched to be unpressurized by a corresponding control of the hydraulic system supplying it. However, a pushing-back of the clutch member 15 by means of the pressure spring 34 will only be possible when the second locking device 42 is released. Up to that point, the end of the flexible tongue 27 resting against the stop 37 will prevent the pushing-back. In the case of the end position of the clutch member 15 illustrated in FIG. 5, (in the case of an unpressurized piston 14) the valve stem 10 dips into the bore 35 of the clutch member 15. When, while interacting with the adjusting plate 19, the cam 3 arrives in the area of its highest cam lobe (NbII), the valve stem 10 is dipped almost completely into the bore 35 as a result of a corresponding pressing-down of the tappet 1 and rests against the flexible tongue 27. By means of a complete pressing-down of the tappet 1 in the area of the cam tip, that is, in the cam area with the highest lobe, the flexible tongue 27 is lifted to the cup bottom 18 (FIG. 6). After the unlocking of the second locking device 42, the clutch member 15 can be pushed to the left by the pressure spring 34. Despite the dipped-in valve stem 10, this displacement is possible because of the different diameters of the valve stem 10 and the bore 35. The clutch member 15 is pushed to the left by the pressure spring 34 until the wall of the bore 35 rests against the valve stem 10. In this intermediate position Zs, the end of the flexible tongue 27 rests on the stop 26 so that no new locking is possible. A complete pushing-back of the clutch member 15 into the first (left) end position is possible after the valve stem 10 has dipped completely out of the bore 35; that is, in the area of the interaction of the base circle 39 with the adjusting plate 19. The clutch member 15 is pushed to the left until it rests against the extension 21 and the extension 38 is again pressed into the opening 31. The valve 2 and the tappet are again in the activated position illustrated in FIG. 2.

As a result of the above-described locking of the clutch member 15 in the two end positions or the two switching positions of the valve 2 and the unlocking by the valve stem 10, a defined switching operation is ensured during which the displacement of the clutch member 15 takes place essentially during the interaction of the base circle 39 and the adjusting plate 19.

The above-described assignment of end positions of the clutch member and switching positions of the valve as well as the assignment between the switching positions or end positions and the individual locking devices is to be considered a preferred contemplated embodiment. There are also other contemplated embodiments. Thus, for example, the valve 2 may be switched off in the first (left) end position of the clutch member and may be activated in the second (right) end position.

Furthermore, modifications of the locking devices are also contemplated by the invention. Thus, for example, the spring element interacting with the first locking device 41 may be constructed independently of the second locking device 42.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Tappet for an internal combustion engine valve comprising:

a tappet member which in use is moved by a cam of an engine camshaft, a clutch member movable between a first switching position transmitting tappet member movements to an engine valve and a second switching position without transmitting tappet member movements to the engine valve, whereby an associated engine valve can be switched between operating and non operating conditions, a selectively movable piston operable to move said clutch member between said first and second switching positions, and first and second locking devices operable to lock the clutch member in respective end positions assigned to the first and second switching positions, said first and second locking devices being operably acted on during use by a valve stem of the engine valve to effect unlocking of said locking devices.

2. Tappet according to claim 1, wherein the locking of the clutch member takes place in each case by means of a locking spring element when respective end positions of the clutch member are reached.

3. Tappet according to claim 1, wherein the clutch member is movable between first and second end positions and has a bore into which the valve stem dips in the first end position of the clutch member, and wherein in the dipped-in condition, the valve stem unlocks one of the locking devices.

4. Tappet according of claim 1, wherein the clutch member is movable between first and second end positions, and wherein the valve stem rests against the clutch member when the clutch member is in said second end position, and wherein the valve stem unlocks one of the locking devices when the tappet is subsequently activated by the cam.

5. Tappet according to claim 1, wherein the clutch member has spaced supporting surfaces on which the piston and a return spring element are supported.

6. Tappet according to claim 3, wherein the clutch member is fixed in a first cam path area and in the second switching position by the second assigned locking device, whereas the second locking device in a second cam path area in the case of this second switching position is unlocked by the valve stem, whereby, as a result of the interaction of the piston and the effect of a return spring element, the clutch member is moved from the second end position first into an intermediate position and, in the following first cam path area, is moved into the second switching position, from which, in the first cam path area, in the case of an opposite interaction of the piston and of the spring element, the clutch element is guided back into the second switching position.

7. Tappet according to claim 6, wherein, for achieving the intermediate position, the diameter of the bore in the clutch member is larger than the diameter of the valve stem.

8. Tappet according to claim 1, wherein the tappet member is constructed in the shape of a cup and comprises a shell part, a cup bottom and an interior enclosed thereby, and wherein the piston, the locking devices, the clutch member and a return spring element are placed in the interior.

9. Tappet according to claim 8, wherein one of the locking devices is arranged between the cup bottom and the clutch member.

10. Tappet according to claim 1, wherein the clutch member can be displaced on a guideway and can be lifted by the valve stem approximately perpendicularly thereto, and wherein one of the locking devices is formed by releasably engaging parts of the clutch member and of the guideway.

11. Tappet according to claim 10, wherein the clutch member can be lifted against the effect of a locking spring element by the valve stem.

12. Tappet according to claim 11, wherein the locking spring element is formed as a portion of one of said locking devices arranged on the cup bottom.

13. Tappet according to claim 10, wherein the guideway has an opening in which an extension of the clutch member engages in the locking position of the assigned locking device.

14. Tappet according to claim 1, wherein a portion of one of the locking devices is arranged on a cup bottom of the tappet housing and is constructed as a flexible tongue on a shaped part inserted into the tappet housing.

15. Tappet according to claim 10, wherein the guideway is constructed on a guide plate which is inserted into the tappet housing, wherein this guide plate can be penetrated by the valve stem, and wherein the clutch member can be displaced on the guide plate.

16. Tappet according to claim 2, wherein the clutch member has a bore into which the valve stem dips in a first end position, and wherein in the dipped-in condition, the valve stem unlocks one of the locking devices.

17. Tappet according to claim 16, wherein the valve stem rests against the clutch member when the clutch member is in said second end position, and wherein the valve stem unlocks one of the locking devices when the tappet is subsequently activated by the cam.

18. Tappet according to claim 17, wherein the clutch member has spaced supporting surfaces on which the piston and a return spring element are supported.

19. Tappet according to claim 2, wherein the tappet member is constructed in the shape of a cup and comprises a shell part, a cup bottom and an interior enclosed thereby, and wherein the piston, the locking devices, the clutch member and a return spring element are placed in the interior.

20. Tappet according to claim 19, wherein one of the locking devices is arranged between the cup bottom and the clutch member.

21. Tappet according to claim 20, wherein the clutch member can be displaced on a guideway and can be lifted by the valve stem approximately perpendicularly thereto, and wherein one of the locking devices is formed by releasably engaging parts of the clutch member and of the guideway.

22. Tappet according to claim 21, wherein the clutch member can be lifted against the effect of a locking spring element by the valve stem.

23. Tappet according to claim 22, wherein the locking spring element is formed, as a portion of one of said locking devices arranged on the cup bottom.

24. Tappet according to claim 23, wherein the guideway has an opening in which an extension of the clutch member engages in the locking position of the assigned locking device.

25. Tappet according to claim 8, wherein the clutch member has a bore into which the valve stem dips in a first end position, and wherein in the dipped-in condition, the valve stem unlocks one of the locking devices.

26. Tappet according to claim 24, wherein the clutch member has a bore into which the valve stem dips in a first end position, and wherein in the dipped-in condition, the valve stem unlocks one of the locking devices.

* * * * *